US006615622B2

(12) United States Patent
MacAleese et al.

(10) Patent No.: US 6,615,622 B2
(45) Date of Patent: Sep. 9, 2003

(54) MULTI-PURPOSE POLICE BATON

(75) Inventors: Gregory B. MacAleese, Colorado Springs, CO (US); Chris Zuidema, Colorado Springs, CO (US); David Bush, Colorado Springs, CO (US); Jim Roies, Colorado Springs, CO (US); Jim Moore, Colorado Springs, CO (US)

(73) Assignee: Law Enforcement Technologies, Inc., Colorado Springs, CO (US)

( * ) Notice: Subject to any disclaimer, the term of this patent is extended or adjusted under 35 U.S.C. 154(b) by 0 days.

(21) Appl. No.: 10/058,359

(22) Filed: Oct. 18, 2001

(65) Prior Publication Data

US 2002/0166350 A1 Nov. 14, 2002

Related U.S. Application Data

(63) Continuation-in-part of application No. 09/566,165, filed on May 5, 2000, now abandoned.
(60) Provisional application No. 60/132,555, filed on May 5, 1999.

(51) Int. Cl.[7] ..... E05B 75/00
(52) U.S. Cl. ..... 70/16; 463/47.4
(58) Field of Search ..... 70/15–17; 119/802, 119/803, 804; 128/869, 876, 878, 879, 882; 463/47.2, 47.5, 47.4

(56) References Cited

U.S. PATENT DOCUMENTS

| | | | | |
|---|---|---|---|---|
| 153,312 | A | 7/1874 | Broome et al. | |
| 511,148 | A | * 12/1893 | Jones | |
| 1,203,778 | A | 11/1916 | Pratt | 70/16 |
| 1,463,776 | A | * 7/1923 | Knudtson | |
| 1,476,895 | A | * 12/1923 | Langenbacher | |
| 1,586,412 | A | 5/1926 | Curtis | |
| 1,803,280 | A | 4/1931 | Stull et al. | |
| 2,949,761 | A | 8/1960 | Mitchell et al. | 70/16 |
| 4,034,982 | A | 7/1977 | Rupprecht et al. | |
| 4,455,023 | A | 6/1984 | Saloom | |
| 4,559,737 | A | * 12/1985 | Washington | 43/59 |
| 4,840,048 | A | 6/1989 | Elam | 70/16 |
| 4,964,419 | A | 10/1990 | Karriker | 70/16 X |
| 5,099,662 | A | 3/1992 | Tsai | 70/16 |
| 5,197,734 | A | * 3/1993 | Ashihara | |
| 5,326,101 | A | * 7/1994 | Fay | 43/59 X |
| 5,330,181 | A | * 7/1994 | Wong | |
| 5,400,623 | A | 3/1995 | Bota | 70/16 |
| 5,555,751 | A | 9/1996 | Strickland et al. | 70/16 |
| 5,593,159 | A | 1/1997 | Otake | 70/15 X |
| 5,669,110 | A | 9/1997 | Parsons | 70/16 X |
| 5,680,781 | A | 10/1997 | Bonds et al. | 70/16 |
| 5,706,679 | A | * 1/1998 | Zane et al. | 70/18 |
| 5,797,404 | A | 8/1998 | Stanchin, II | 70/16 X |
| 5,799,520 | A | * 9/1998 | Laabs et al. | 70/360 |
| 5,802,675 | A | 9/1998 | Parsons | 70/16 X |
| 5,842,601 | A | * 12/1998 | Pierpoint | 222/1 |
| 5,893,799 | A | 4/1999 | Studley, Jr. et al. | 463/47.2 |
| 5,979,106 | A | * 11/1999 | Butler | 43/87 |
| 6,026,661 | A | 2/2000 | Spiropoulos | 70/16 |
| 6,334,444 | B1 | * 1/2002 | Sisco | 70/16 X |

OTHER PUBLICATIONS

NIK® Public Safety, Inc., "FLEX–CUF® Restraints", package label, became aware of this product on May 28, 2001.

* cited by examiner

*Primary Examiner*—Lloyd A. Gall
(74) *Attorney, Agent, or Firm*—Jeffrey D. Myers

(57) ABSTRACT

A cuff device comprising an elongated body, a flexible cable within the body, a loop extraction system for extracting a loop of the cable from an end of the elongated body large enough to fit over an extremity of a suspect, and a loop retraction system for retracting the loop to fit snugly over the extremity. A second cable is preferred, with one cable deployed from each end of the elongated body, preferably a PR-24 form factor baton.

14 Claims, 17 Drawing Sheets

MULTI-PURPOSE POLICE BATON

CROSS-REFERENCE TO RELATED APPLICATIONS

This application is a continuation-in-part application of U.S. patent application Ser. No. 09/566,165, entitled "Rapidly Deployable Cuff Device", filed on May 5, 2000, now abandoned, which claims the benefit of the filing of U.S. Provisional Patent Application Serial No. 60/132,555, entitled "Personnel Immobilization Devices", filed on May 5, 1999, and the specifications thereof are incorporated herein by reference.

BACKGROUND OF THE INVENTION

1. Field of the Invention (Technical Field)

The present invention relates to cuff devices for immobilizing personnel.

2. Background Art

The current, commonly deployed handcuff design has gone essentially unchanged for more than 150 years. They are difficult to apply to a combative suspect because of their small cuff size. If a suspect is able to keep his hands in motion, it often takes several officers to secure the handcuffs. Furthermore, many suspects and prisoners know how to defeat traditional handcuffs, through the use of keys or by simply breaking the handcuffs in two at its weakest link. Additionally, injuries are not uncommon with traditional handcuffs.

Examples of non-traditional cuff devices include U.S. Pat. No. 4,964,419, to Karriker, and U.S. Pat. No. 5,680,781, to Bonds et al. In neither case are the cuff loops fully encased within an elongated body, as with the present invention.

The present invention provides a cuff device that is easily deployed but not easy to defeat. It also doubles as a baton weapon so that officers can carry one item rather than both handcuffs and a baton.

SUMMARY OF THE INVENTION (DISCLOSURE OF THE INVENTION)

The present invention is of a cuff device comprising: an elongated body; a flexible cable fully encased within the body; a loop extraction system for extracting a loop of the cable from an end of the elongated body large enough to fit over an extremity of a suspect; and a loop retraction system for retracting the loop to fit snugly over the extremity. In the preferred embodiment, the device additionally comprises a second flexible cable fully encased within the body and a loop extraction system for extracting the second cable as with the first cable. The elongated body is preferably a baton, most preferably a PR-24 form factor baton. A handle is attached perpendicularly to the elongated body, having a threaded rod and nut system or a piston with a locking device for preventing movement of the loop when retracted over the extremity. The cable is preferably braided steel securely attached to a nut or piston, which travels on a threaded rod or within the baton body. A lock is employed to prevent, when engaged, extraction of the cable. The extraction and retraction system preferably includes a power system, such as DC motors powered by one or more batteries (e.g., a single nine-volt battery). In a device having two loops, a 24-inch long body will keep the suspect's wrists apart by approximately 24 inches when the loops are retracted over the wrists, and a 12-inch long body will keep a suspect's ankles apart by approximately 12 inches when the loops are retracted over the ankles.

A primary object of the present invention is to provide a cuff device that is easily deployed but not easy to defeat.

Primary advantages of the present invention are that it is also useful as a baton and to permit a single officer to readily control a cuffed suspect.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Figure 1:
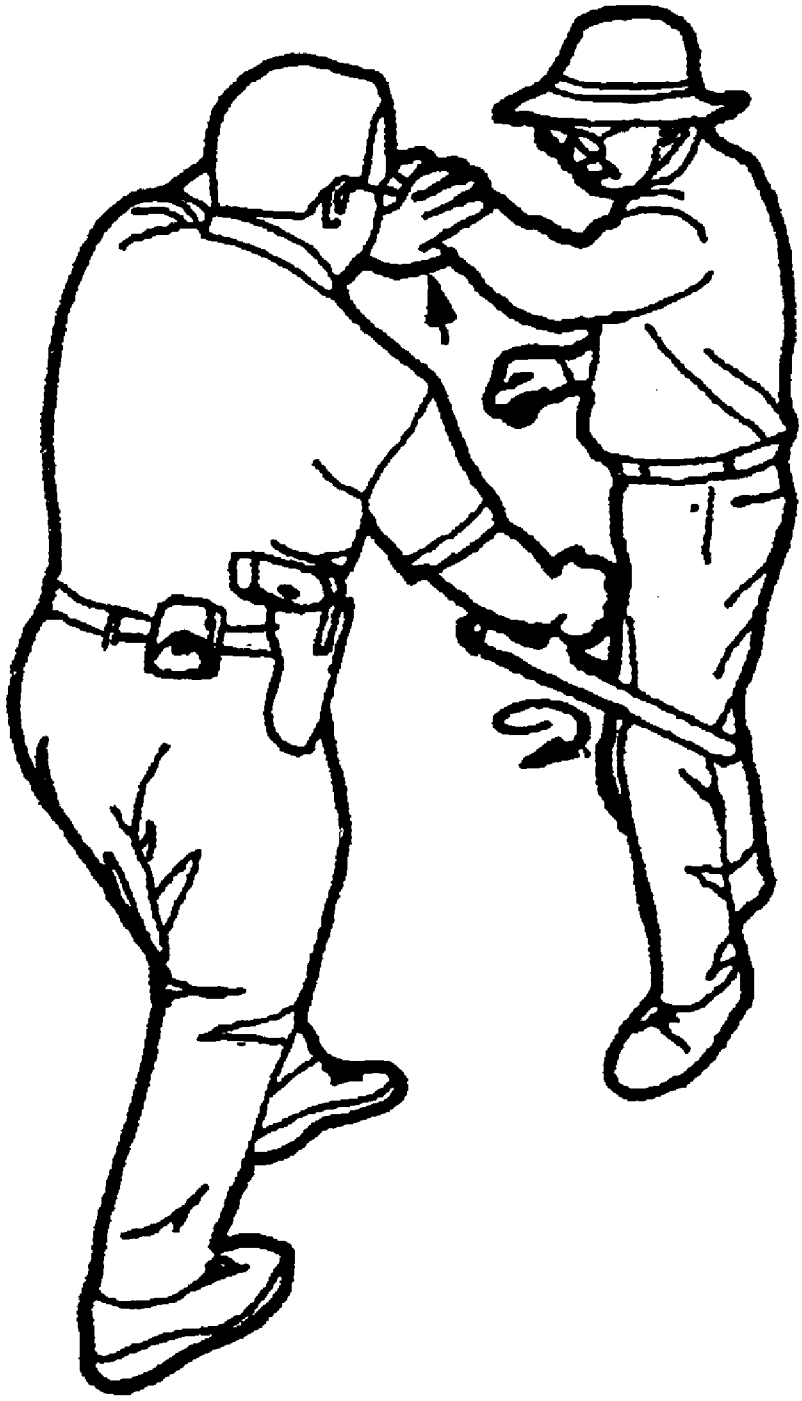
FIGS. 1–18 are a series of drawings illustrating use of the invention to control a suspect.

Best Modes for Carrying out the Invention

The present invention is a flexible cuff device combined with a baton-configuration dispenser. Preferably two cables in a loop configuration are dispensed, one from each end, that fit individually over the two wrists of a suspect. Once the cables have been placed over the wrists, they can be retracted to create a very snug fit. The device can then be locked to prevent unauthorized removal. Alternatively, a single strap can be dispensed to simultaneously fit over both wrists of a suspect.

With two switches 20,20' located on the baton/dispenser (one for each cuff cable), the cuff cables extract out of each end of the baton. The cables fit over each wrist. Once one cable has been placed over a suspect's wrist, the cuff can be immediately retracted with the push of the button on the baton/dispenser to snugly isolate the suspect's wrist on the end of the baton. This gives the operator excellent leverage over a combative suspect. The suspect can now be quickly pulled to the ground or, by twisting the baton/dispenser, the suspect's arm can be bent into an uncomfortable position, thus taking the fight out of the suspect. Then the suspect's second wrist can be easily secured. The baton/dispenser has the added advantage of being used as a defensive device by the officer.

The present invention renders it much more difficult to physically overwhelm the restraints because the design forces the suspect's arms far apart, thus reducing leverage, and the cuff material preferably has a breaking strength of approximately 1200 pounds. Additionally, the design makes it physically impossible for a restrained suspect to unlock the device with a key.

The tactical baton/handcuff system of the invention is preferably deployed in a PR-24 form factor model, which is the form factor for the baton most commonly in use in the United States of America today (e.g., the Monadnock PR-24 Control Baton). The cables are preferably two 24" long, 0.125" diameter 7×19 braided galvanized steel cable. The main body tubing is preferably made from extruded aluminum tubing preferably having a diameter of 1.25" and a wall thickness of 0.125". The perpendicular handle is preferably made from extruded aluminum tubing preferably having a diameter of 1.25" and a wall thickness of 0.062". The main body tubing and the handle tubing are preferably welded together. The handle end cap and main body end caps are preferably made from injection-molded nylon. A high security key-lock is preferably included, most preferably a round multi-tumbler key-lock installed into the handle end cap.

Electrical cable drives are preferred in conjunction with DC motors and a battery. The motors preferably drive a threaded rod and a nut to which the cables are attached. The motors are preferably set such that retraction ceases when resistance to retraction occurs, such as when a suspect's wrist or ankle is tightly held by the cable loop. As will be readily understood by those of skill in the art, a variety of pneumatic, electrical, and mechanical power means can be employed, and the baton/dispenser can be made retractable. Furthermore, the cuff device of the invention can be deployed within a unit that is shorter than a standard police baton and used as a leg hobbler, or within a unit that is collapsible or foldable to make the unit more compact.

Figure 2:
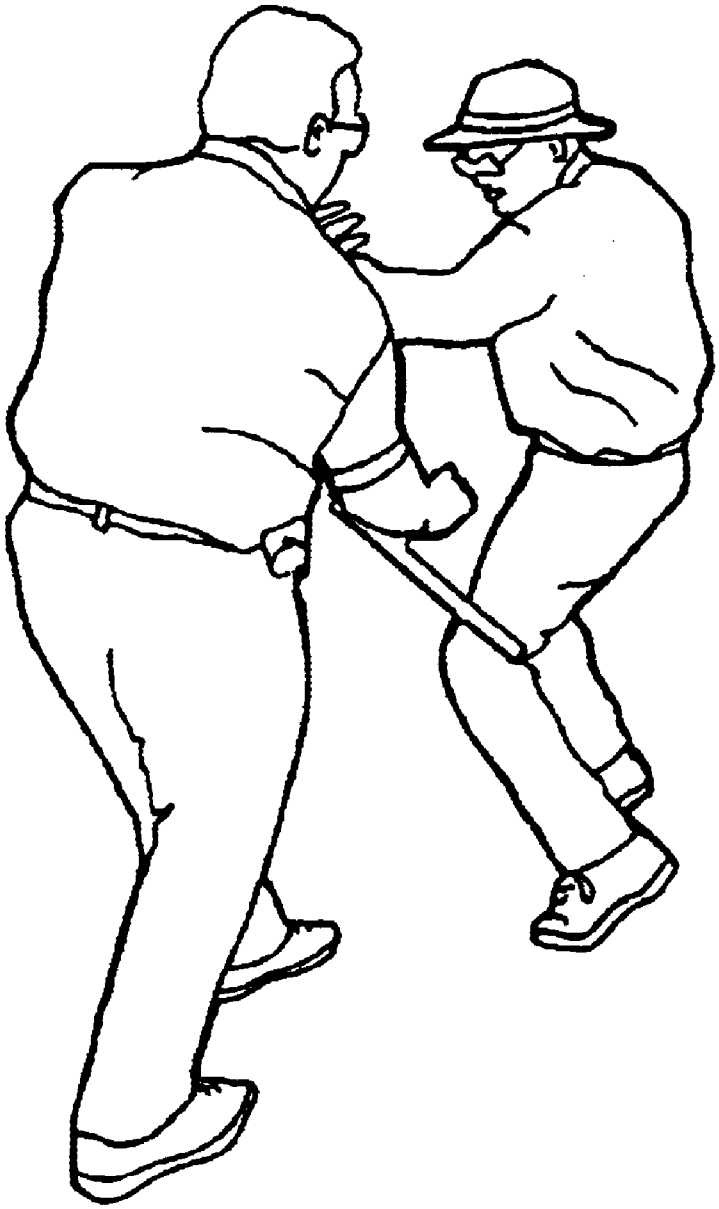
Figure 3:
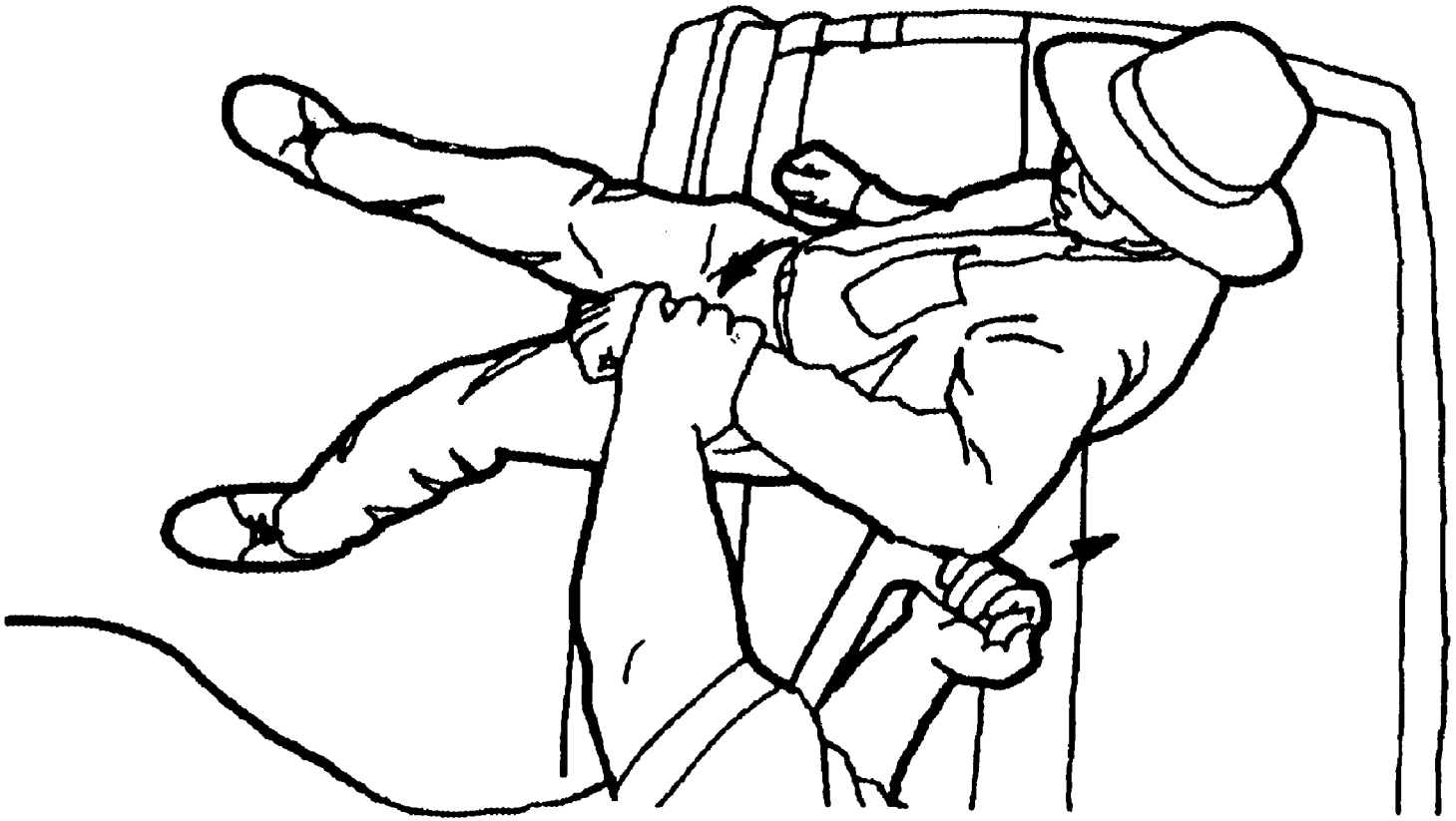
Figure 3A:
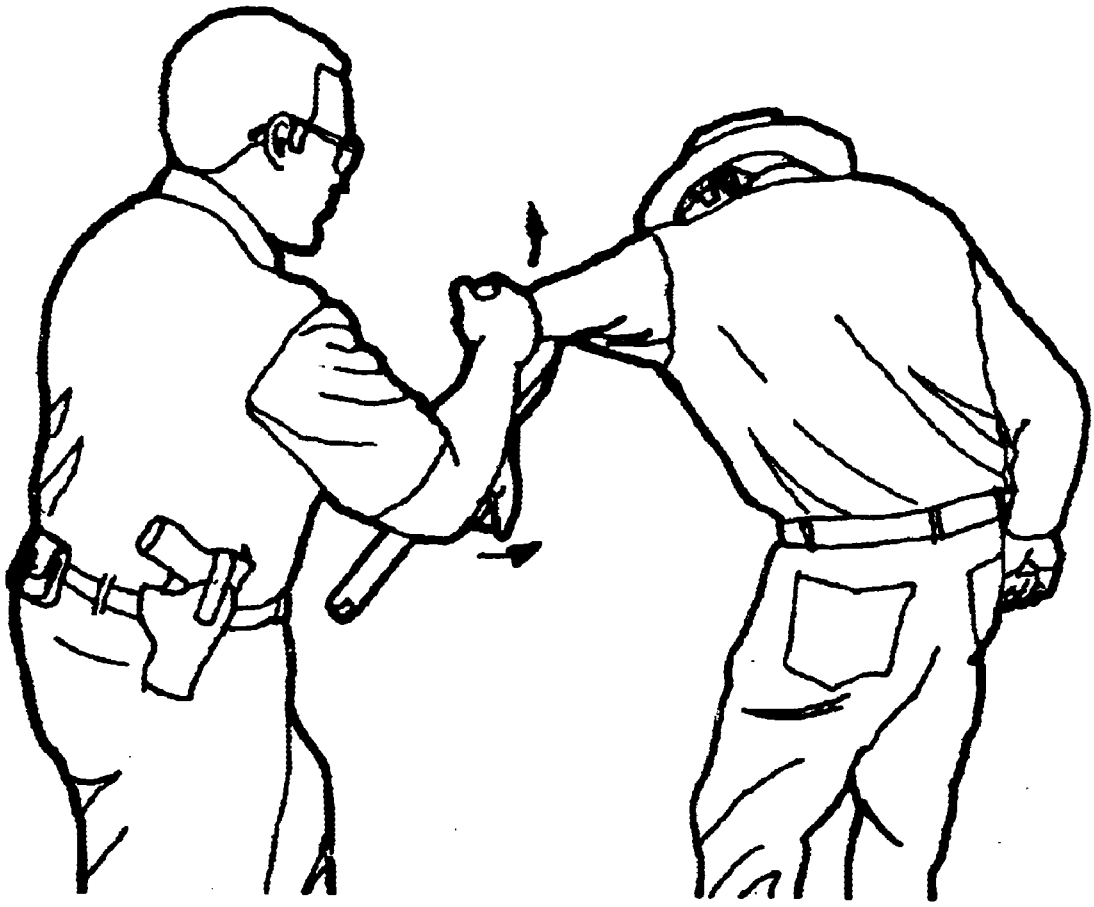
Figure 4:
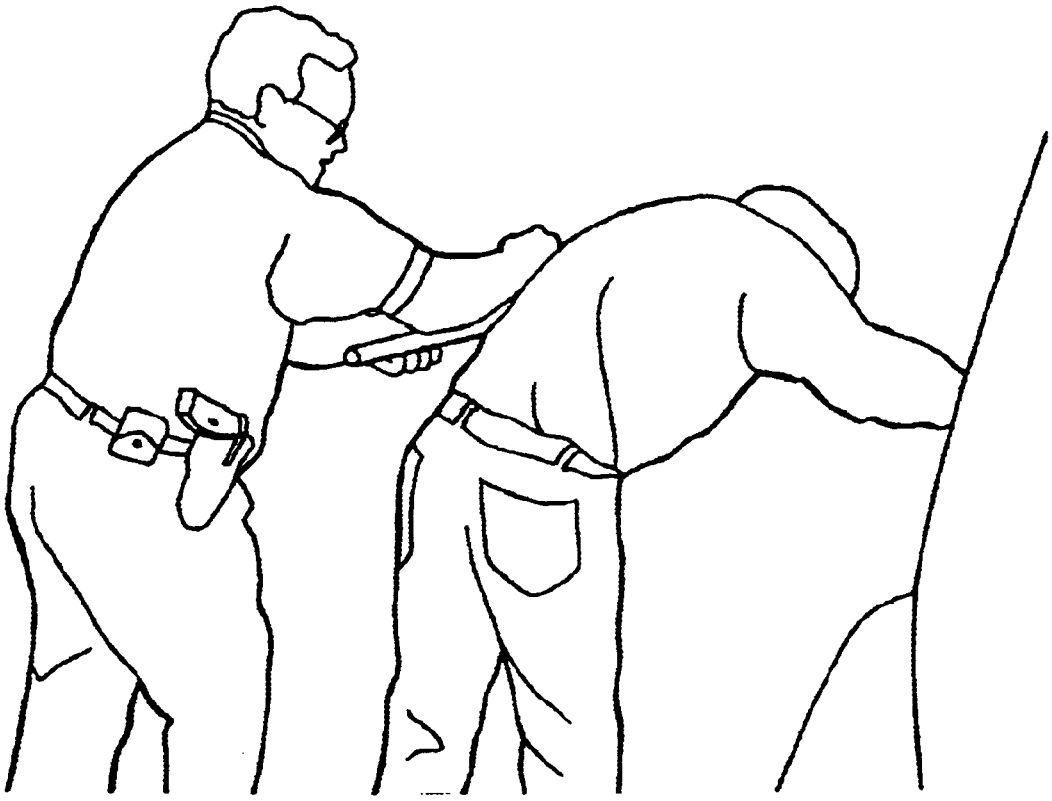
Figure 5:
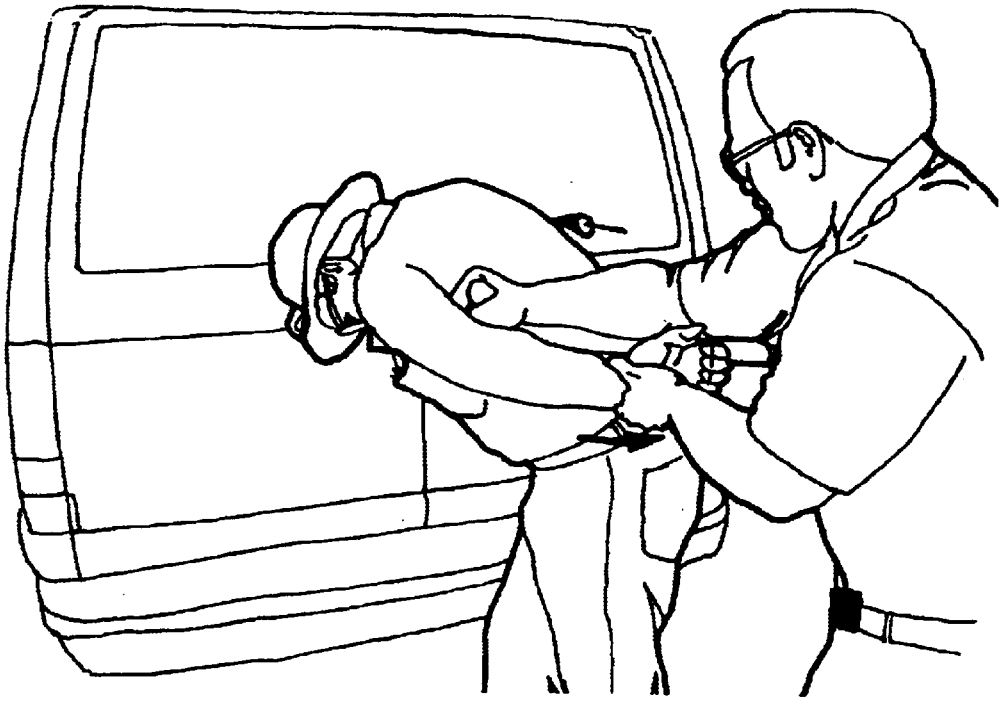
Figure 6:
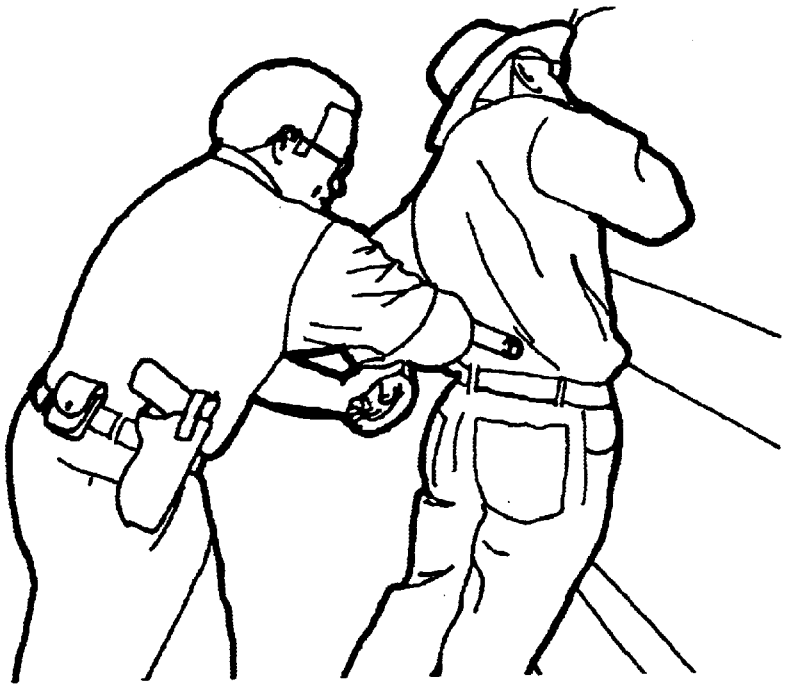
Figure 7:
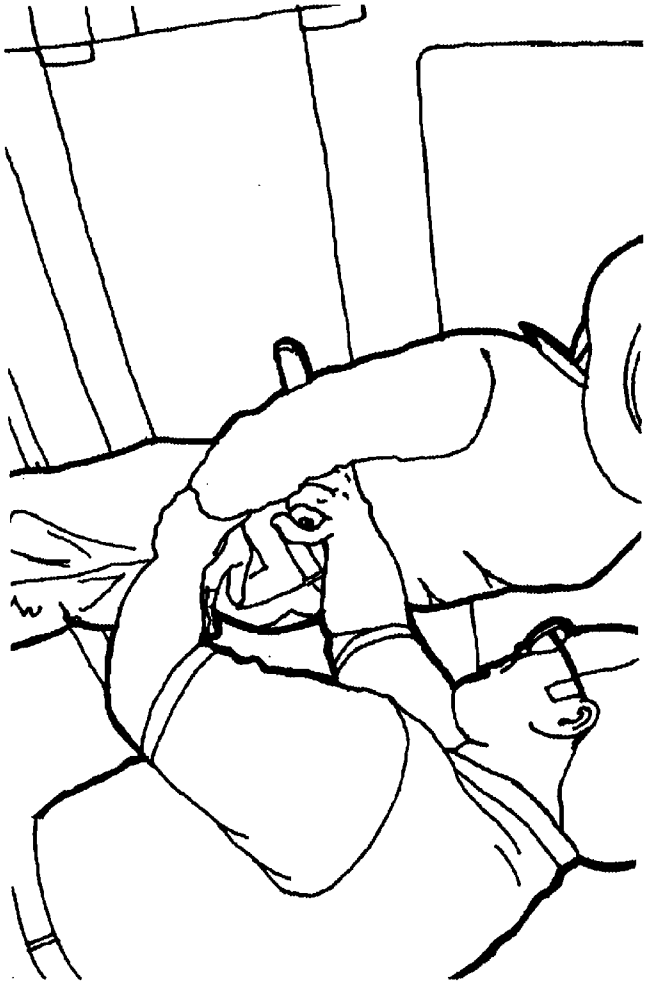
Figure 8:
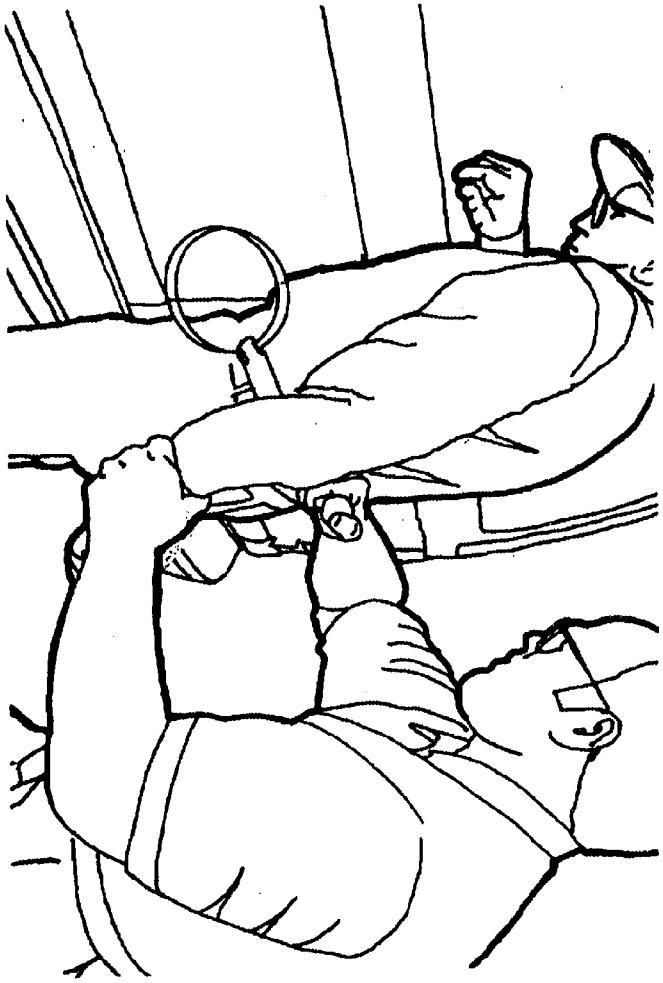
Figure 9:
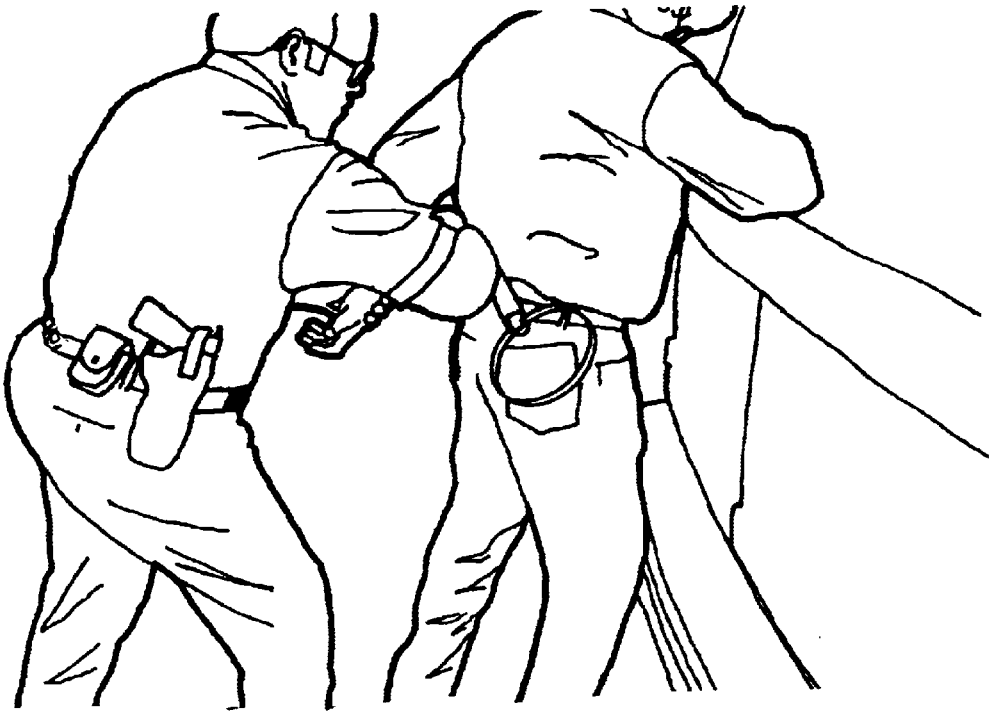
Figure 10:
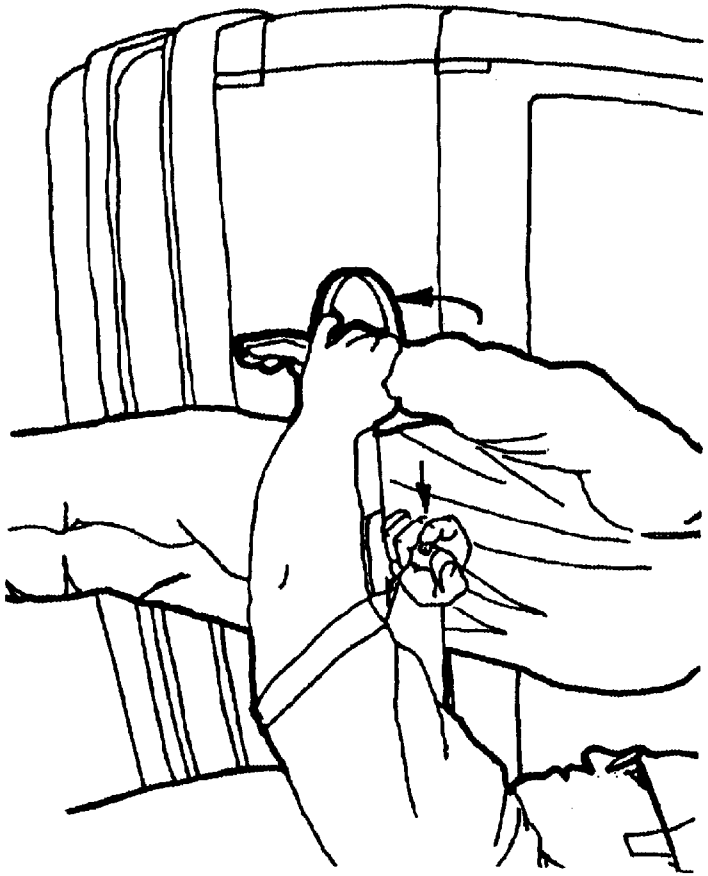
Figure 11:
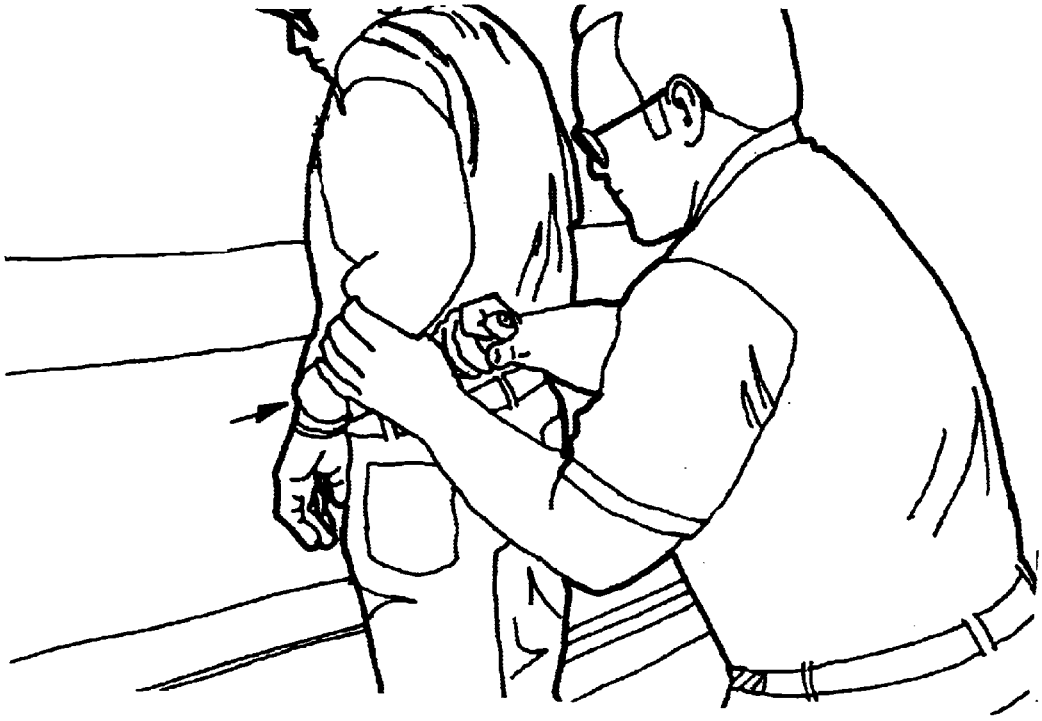
Figure 12:
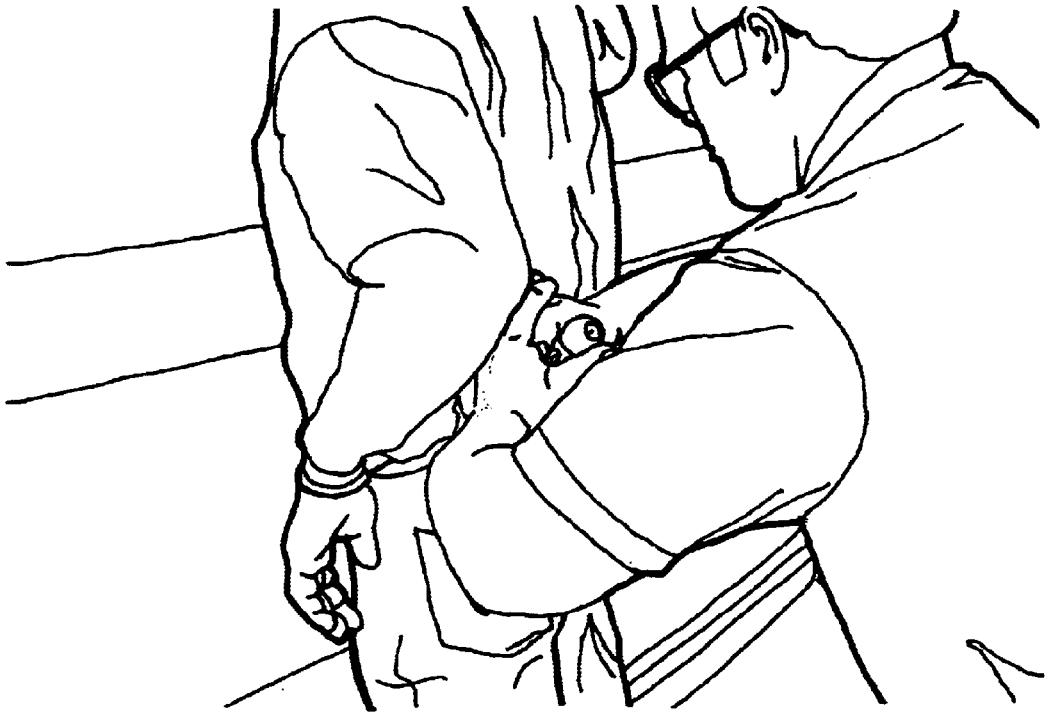
Figure 13:
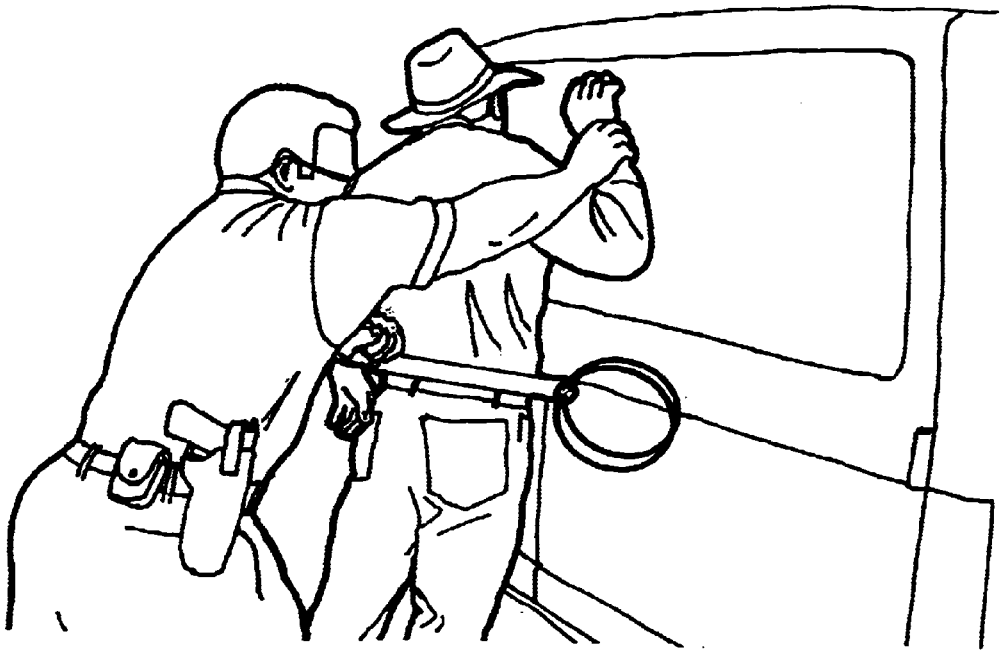
Figure 14:
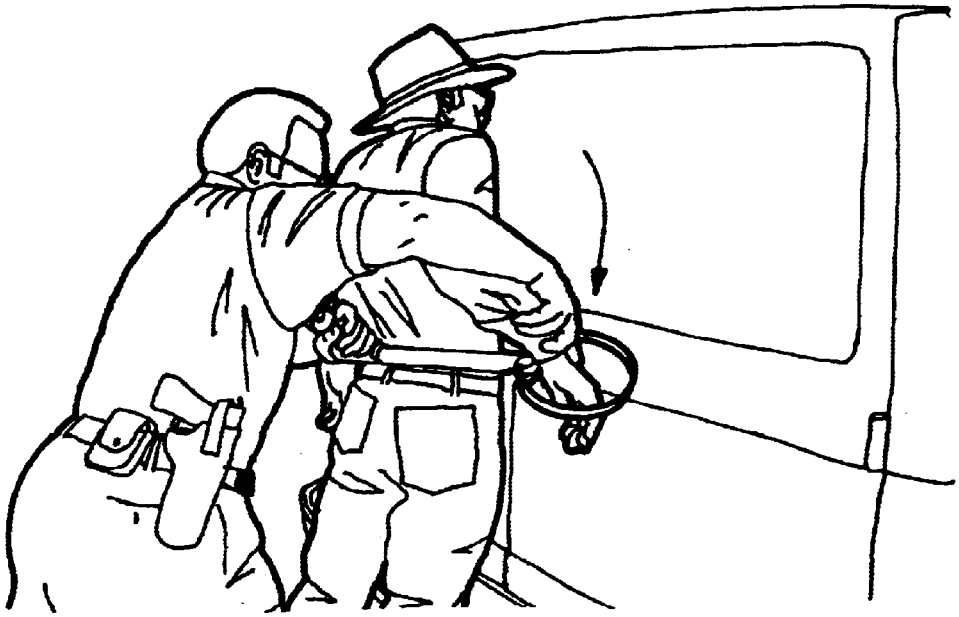
Figure 15:
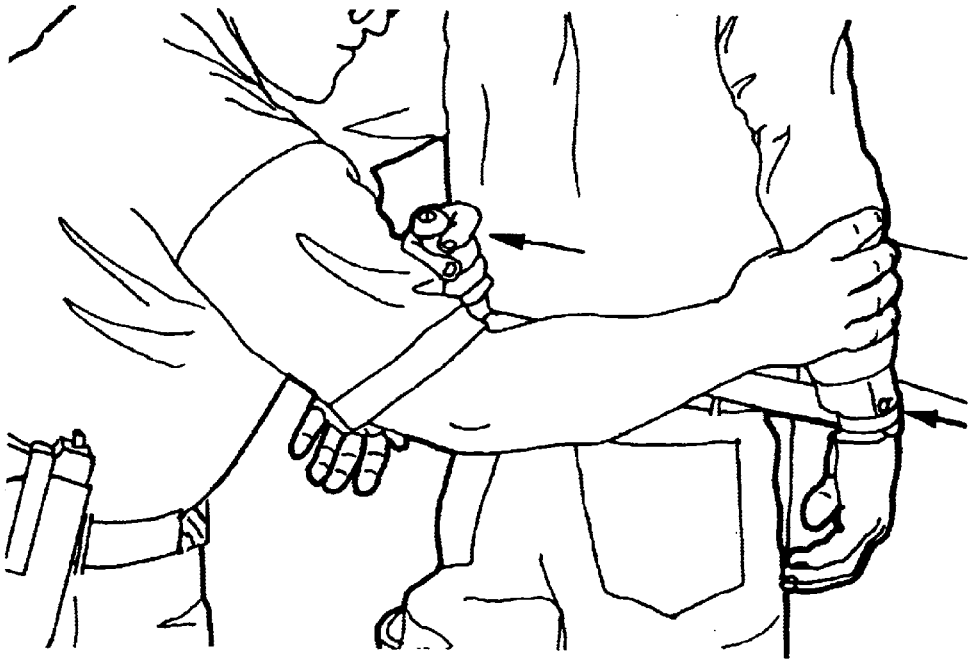
Figure 16:
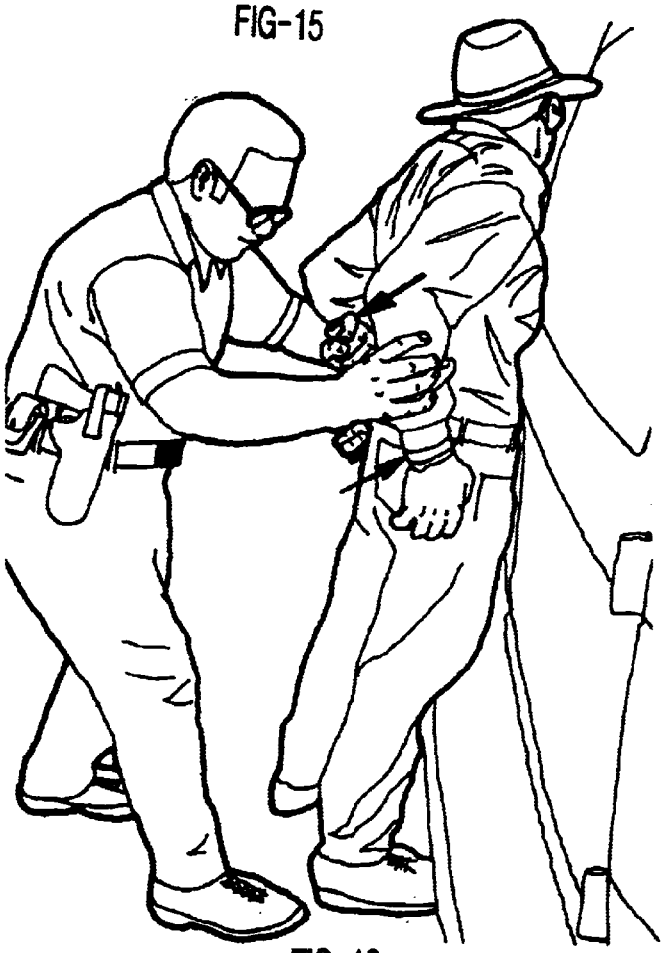
Figure 17:
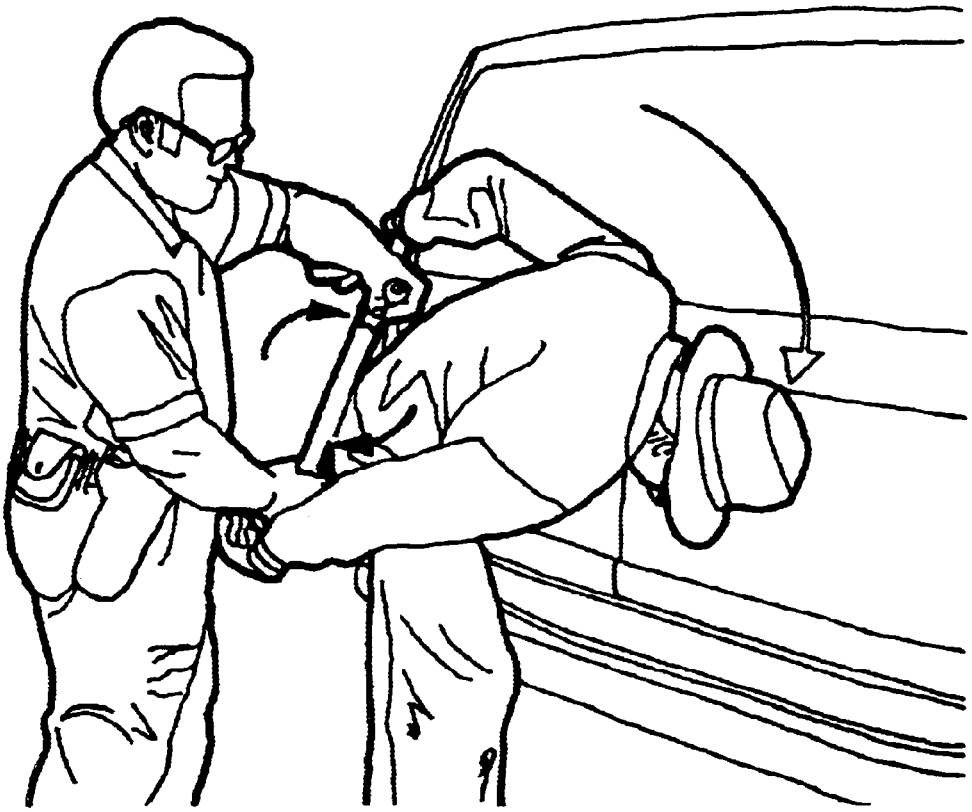
Figure 18:
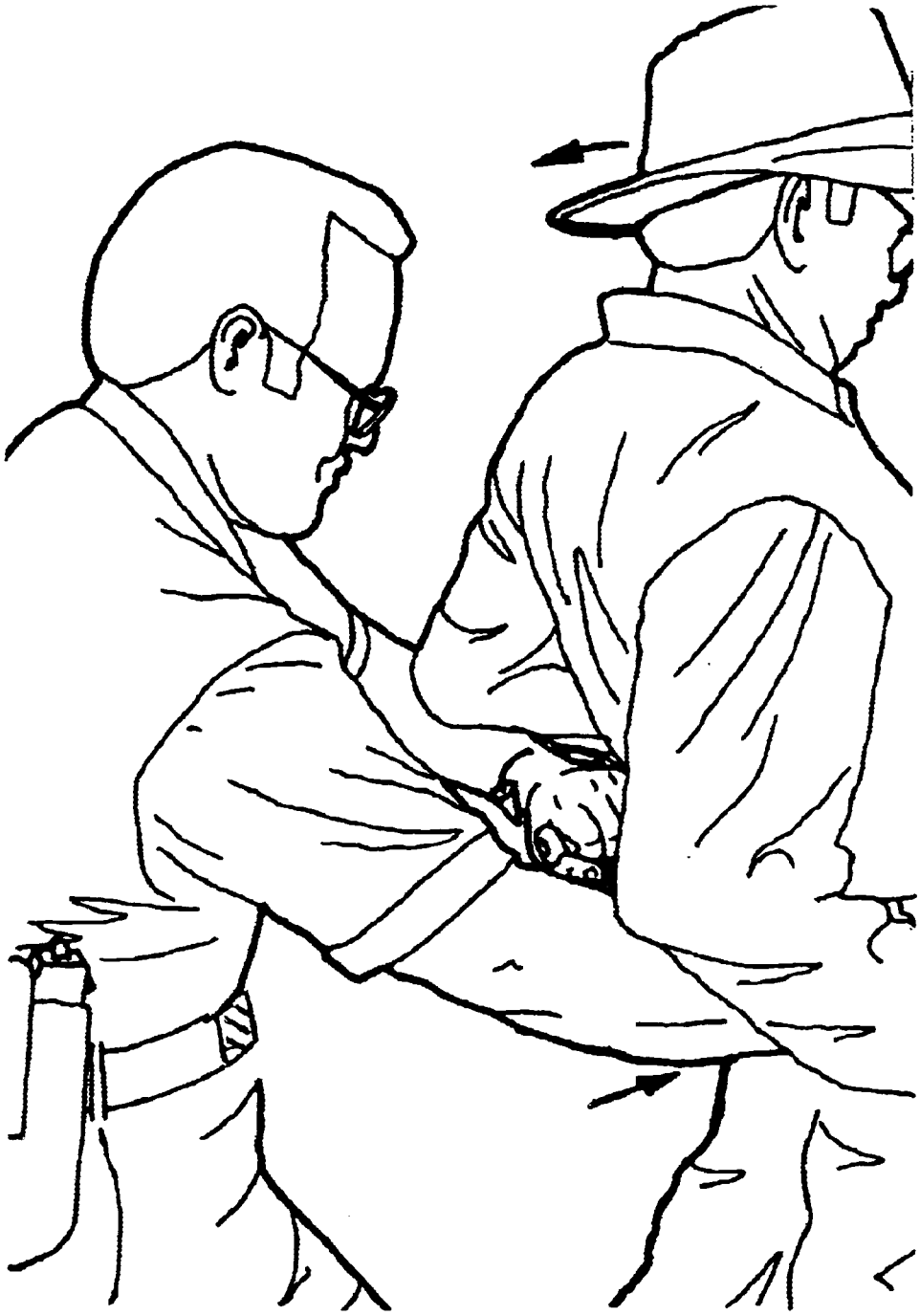
Figure 19:
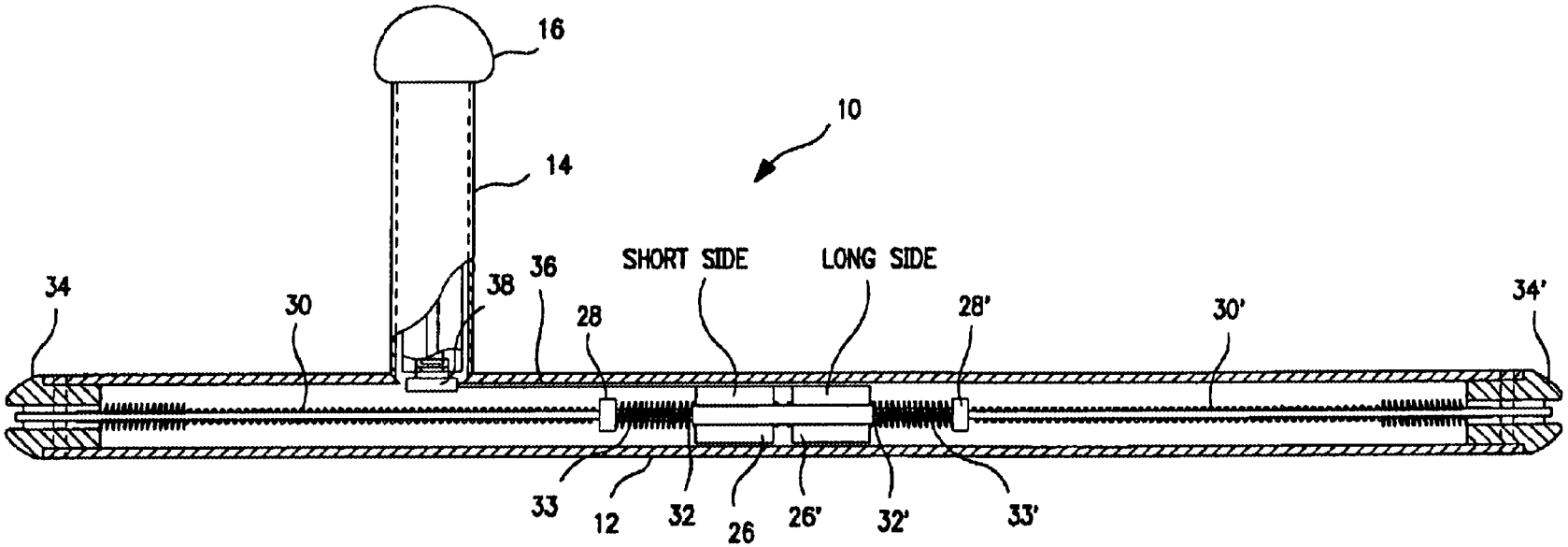
FIG. 19 is a sectional view of the invention with both straps retracted.
Figure 20:
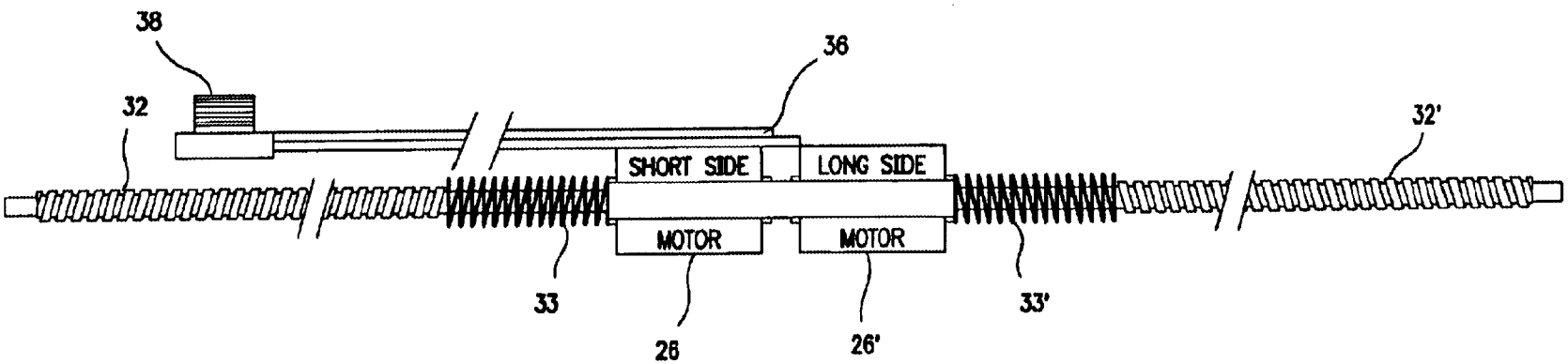
FIG. 20 is a side view of the motor/shaft assembly of the invention.
Figure 21:
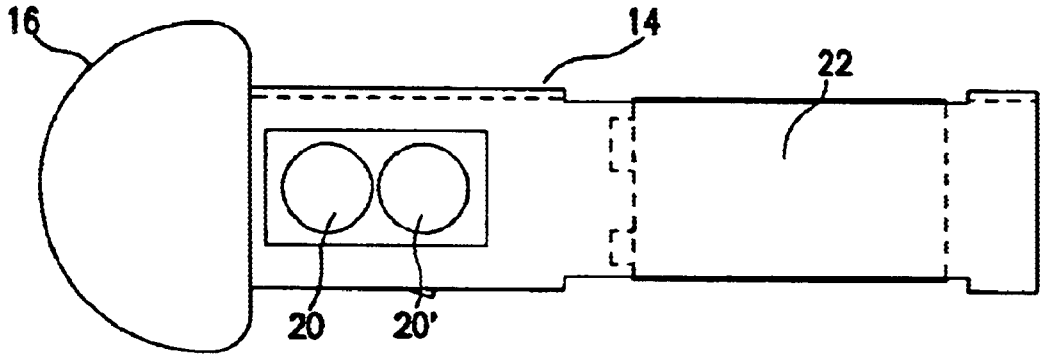
FIG. 21 is side view of the handle of the invention.
Figure 22:
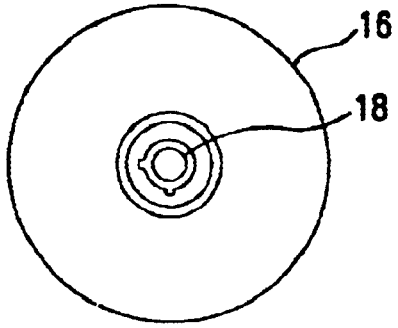
FIG. 22 is an end view of the handle of the invention.
Figure 23:
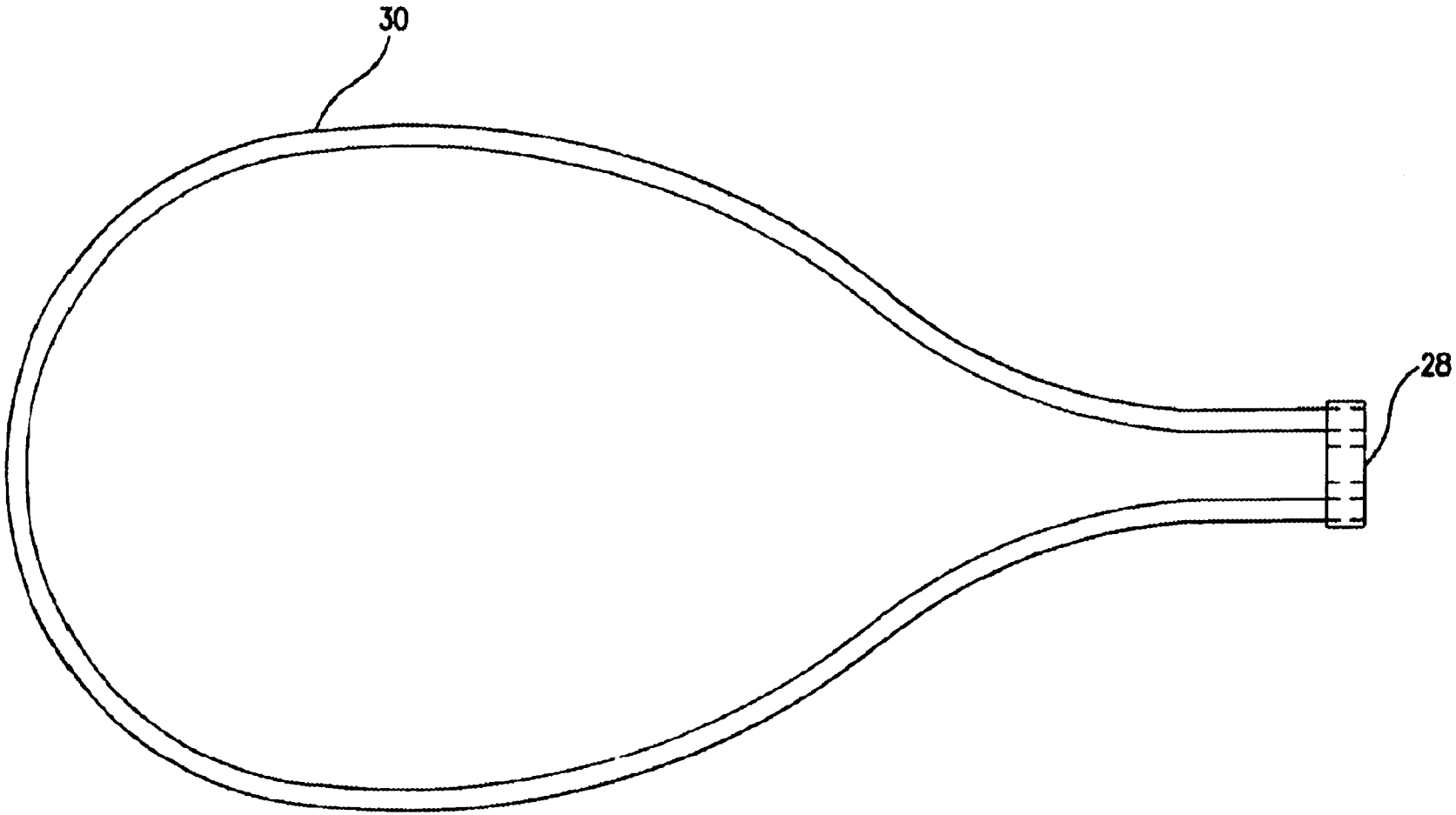
FIG. 23 is a view of the piston/cable assembly of the invention.

Referring to FIGS. 1–18, these figures illustrate the use of the preferred embodiment of the invention to restrain a suspect. In FIG. 1, the officer (left) is approached by a confrontational man (right). The officer swings the invention at the suspect's right knee to knock him off balance. In FIG. 2, as the suspect loses balance, the officer grabs his left arm. In FIGS. 3 and 3(*a*), the officer uses the invention as leverage to spin the suspect around. In FIGS. 4–5, the officer continues to turn the suspect away from him and uses the invention to help twist the suspect's left arm behind him. In FIGS. 6–7, the officer now places the invention in the small of the suspect's back to further immobilize him. In FIGS. 8–9, the officer extracts the straps from the two ends of the baton/dispenser by pressing a button on the baton's handle. In FIG. 10, the officer places the suspect's left hand in the cuff strap while still using the baton's location in the suspect's small of the back to immobilize him. In FIG. 11, the officer now presses a button on the baton handle in order to retract the left cuff. Notice that the baton is still pressed in the suspect's small of the back and that the suspect is completely immobilized and that his left hand and arm are now under control. In FIG. 12, while still pressing the baton in the suspect's small of the back, the officer now switches his grip on the baton handle in order to put the suspect's right hand in the second cuff. In FIGS. 13–14, the officer now presses a second button on the baton handle and grabs the suspects right wrist to begin bringing it back to be placed in the right cuff strap. The suspect is still immobilized. Note that the officer would be able to achieve the same position even without the presence of a wall or vehicle by pulling the suspect to the ground. In FIG. 15, the officer presses the second button on the baton handle to immediately retract the cuff strap on the suspect's right wrist. In FIGS. 16–17, the suspect is now completely secured. The entire operation can take less than four seconds. If the suspect continues to resist, the officer can easily control the suspect by a simple twist of the baton to pull him off balance. The officer can also rotate the handle of the baton by about 10 degrees in order to torque the suspect's back and keep him off balance. The suspect is now ready to be placed in a law enforcement vehicle.

Referring to FIGS. 19–23, the cuff device 10 comprises an elongated body 12 (preferably a PR-24 form baton), preferably made of aluminum. The short handle portion 14 of the body preferably comprises a handle cap 16, a keyed locking switch 18, momentary switches 20,20' for controlling extrusion and retraction of the cable loops, and one or more batteries 22 (preferably a single nine-volt battery). The elongated body preferably comprises two motors 26,26' (one for each cable loop), preferably nine-volt electric motors, pistons 28,28', cables 30,30', motor screw shafts 32,32', springs 33,33', handle end caps 34,34', wiring harness 36 (preferably of 24 gauge spring steel wire), and battery terminal adapter 38 (preferably a 4 pine male threaded terminal adapter).

Again, the present invention provides a cuff system that is easier to deploy than standard cuffs, can be better used to control a suspect, and is less likely to injure a struggling suspect. The multi-purpose baton of the invention can incorporate other features, including in embodiments without the flexible cables or with only a single flexible cable. For example, an end of the baton can incorporate one of the following: (1) a tear gas, pepper spray, or other form of chemical irritant dispenser that is inserted into one end of the baton and can be activated by pressing a button on the handle of the baton; (2) an electric stun gun attachment that can fit over one end of the baton and can be activated by pressing a button on the handle of the baton; (3) a catch-net launcher that can fit externally over one end of the baton and can launch a nylon catch net to entangle a suspect by pressing a button on the handle of the baton; and (4) a ring airfoil projectile launcher that can fit externally over one end of the baton and can launch a ring airfoil projectile at a target by pressing a button on the handle of the baton.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A multi-purpose police baton comprising:

an elongated body;

a flexible cable completely encased within said body;

means for extracting a loop of said cable from an end of said elongated body large enough to fit over an extremity of a suspect; and means for retracting said loop to fit snugly over the extremity; piston means for connecting said cable to said retracting and extracting means; and wherein said retracting and extracting means comprise means for powering retraction and extraction comprising a DC motor.

2. The multi-purpose police baton of claim 1 additionally comprising:

a second flexible cable completely encased within said body;

means for extracting a second loop of said second cable from an end of said elongated body large enough to fit over a second extremity of a suspect; and means for retracting said second loop to fit snugly over the second extremity.

3. The multi-purpose police baton of claim 2 wherein said elongated body has a length of approximately 24 inches, thereby keeping the suspect's wrists apart by over approximately 24 inches when said loops are retracted over the wrists.

4. The multi-purpose police baton of claim 2 wherein said elongated body has a length of approximately 12 inches, thereby keeping the suspect's ankles apart by over approximately 12 inches when said loops are retracted over the ankles.

5. The multi-purpose police baton of claim 1 wherein said elongated body comprises a PR-24 form factor.

6. The multi-purpose police baton of claim 1 additionally comprising a handle attached perpendicularly to said elongated body.

7. The multi-purpose police baton of claim 6 wherein said handle comprises switch means for controlling said retracting and extracting means.

8. The multi-purpose police baton of claim 7 wherein said handle comprises locking means to prevent operation of said switch means.

9. The multi-purpose police baton of claim 1 wherein said cable comprises a braided steel cable.

10. The multi-purpose police baton of claim 1 additionally comprising locking means to prevent, when engaged, extraction of said cable.

11. The multi-purpose police baton of claim 1 wherein said DC motor drives a drive shaft.

12. The multi-purpose police baton of claim 1 wherein said DC motor comprises a nine-volt DC motor.

13. The multi-purpose police baton of claim 1 wherein said powering means additionally comprises one or more batteries.

14. The multi-purpose police baton of claim 13 wherein said powering means additionally comprises a single nine-volt battery.

* * * * *